US011421907B2

(12) United States Patent
Kato et al.

(10) Patent No.: US 11,421,907 B2
(45) Date of Patent: Aug. 23, 2022

(54) CONTROLLER OF AIR CONDITIONING SYSTEM, OUTDOOR UNIT, RELAY UNIT, HEAT SOURCE APPARATUS, AND AIR CONDITIONING SYSTEM

(71) Applicant: Mitsubishi Electric Corporation, Tokyo (JP)

(72) Inventors: Naoki Kato, Tokyo (JP); Yuji Motomura, Tokyo (JP); Naofumi Takenaka, Tokyo (JP); Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 94 days.

(21) Appl. No.: 16/965,119

(22) PCT Filed: Apr. 4, 2018

(86) PCT No.: PCT/JP2018/014427
§ 371 (c)(1),
(2) Date: Jul. 27, 2020

(87) PCT Pub. No.: WO2019/193686
PCT Pub. Date: Oct. 10, 2019

(65) Prior Publication Data

US 2021/0041130 A1 Feb. 11, 2021

(51) Int. Cl.
*F24F 11/86* (2018.01)
*F24F 11/84* (2018.01)
(Continued)

(52) U.S. Cl.
CPC ..... *F24F 11/86* (2018.01); *F24F 1/32* (2013.01); *F24F 5/0046* (2013.01); *F24F 11/84* (2018.01)

(58) Field of Classification Search
CPC .... F24F 11/84; F24F 11/86; F24F 1/32; F24F 5/0046
See application file for complete search history.

(56) References Cited

U.S. PATENT DOCUMENTS

2011/0225999 A1 9/2011 Okaichi et al.
2012/0043054 A1* 2/2012 Shimazu ..... F25B 13/00 165/58
(Continued)

FOREIGN PATENT DOCUMENTS

JP 2006-194518 A 7/2006
JP 2006-200814 A 8/2006
(Continued)

OTHER PUBLICATIONS

Japanese Office Action dated Jun. 1, 2021, issued in corresponding Japanese Patent Application No. 2020-512160 (and English Machine Translation).
(Continued)

*Primary Examiner* — Henry T Crenshaw
(74) *Attorney, Agent, or Firm* — Posz Law Group, PLC

(57) ABSTRACT

An air conditioning apparatus has a first mode and a second mode as operation modes. In the first mode, a degree of opening of a first flow rate adjustment valve is fixed to a first degree of opening smaller than 100% and greater than 0%, and an operation frequency of a compressor is varied in accordance with air conditioning performance required of a third heat exchanger. In the second mode, the degree of opening of the first flow rate adjustment valve is varied in accordance with air conditioning performance required of the third heat exchanger. When a difference between the air conditioning performance required of the third heat exchanger and air conditioning performance offered by the third heat exchanger becomes greater than a determination
(Continued)

value, the operation mode is changed from the first mode to the second mode.

7 Claims, 7 Drawing Sheets

(51) Int. Cl.
*F24F 1/32* (2011.01)
*F24F 5/00* (2006.01)

(56) References Cited

U.S. PATENT DOCUMENTS

| | | | | |
|---|---|---|---|---|
| 2014/0150483 | A1* | 6/2014 | Takayama | F25B 30/02 62/160 |
| 2016/0223240 | A1* | 8/2016 | Maeda | F25B 41/37 |
| 2016/0273794 | A1* | 9/2016 | Kotani | F24F 11/83 |

FOREIGN PATENT DOCUMENTS

| | | | |
|---|---|---|---|
| JP | 2007-205604 | A | 8/2007 |
| JP | 2017-003236 | A | 1/2017 |
| WO | 2009/147826 | A1 | 12/2009 |
| WO | 2010/131335 | A1 | 11/2010 |

OTHER PUBLICATIONS

International Search Report of the International Searching Authority dated Jun. 19, 2018 for the corresponding international application No. PCT/JP2018/014427 (and English translation).

* cited by examiner

CONTROLLER OF AIR CONDITIONING SYSTEM, OUTDOOR UNIT, RELAY UNIT, HEAT SOURCE APPARATUS, AND AIR CONDITIONING SYSTEM

CROSS REFERENCE TO RELATED APPLICATION

This application is a U.S. national stage application of International Application PCT/JP2018/014427 filed on Apr. 4, 2018, the contents of which are incorporated herein by reference.

TECHNICAL FIELD

The present disclosure relates to a controller of an air conditioning system, an outdoor unit, a relay unit, a heat source apparatus, and an air conditioning system, and more specifically to a controller of an air conditioning system using a first heat medium and a second heat medium, an outdoor unit, a relay unit, a heat source apparatus, and an air conditioning system.

BACKGROUND

Conventionally, an indirect air conditioning apparatus is known that generates hot and/or chilled water by a heat source apparatus such as a heat pump, and delivers the water to an indoor unit through a water pump and a pipe to perform heating and/or cooling in the interior of a room.

Such an indirect air conditioning apparatus employs water or brine as a heat medium for use, and thus has been receiving increasing attention in recent years in order to reduce refrigerant usage. Japanese Patent Laying-Open No. 2007-205604 discloses such an air conditioning apparatus, in which the capacity of a water pump is controlled depending on the excess or shortage of a total amount of delivered water, and if the state of excess or shortage of the total amount of delivered water does not change after a lapse of a certain period of time since the start of control of the water pump, the temperature of water delivered from a water heater/cooler is adjusted.

Patent Literature

PTL 1: Japanese Patent Laying-Open No. 2007-205604

In an air conditioning apparatus that delivers water or brine to an indoor unit through a water pump as described above, there is a distance between a location where the water or brine is heated and a location where the water or brine is used. Thus, even if the temperature of water delivered from the water heater/cooler is varied upon increase in indoor air conditioning load, it takes time for the water or brine at the varied temperature to pass through a pipe to be actually transported to the indoor side. The indoor load is thus poorly followed, resulting in compromised comfort.

SUMMARY

The present disclosure has been made to solve the problem described above, and has an object to provide a controller of an air conditioning system capable of causing air conditioning performance to immediately follow variation in indoor load, an outdoor unit, a relay unit, a heat source apparatus, and an air conditioning system, in an indirect air conditioning system using water or brine.

A controller of the present disclosure controls an air conditioning apparatus configured to operate in operation modes including a first mode and a second mode, the air conditioning apparatus including: a compressor configured to compress a first heat medium; a first heat exchanger configured to exchange heat between the first heat medium and outdoor air; a second heat exchanger configured to exchange heat between the first heat medium and a second heat medium; a third heat exchanger configured to exchange heat between the second heat medium and indoor air; a first flow rate adjustment valve configured to adjust a flow rate of the second heat medium flowing in the third heat exchanger; and a pump configured to circulate the second heat medium between the third heat exchanger and the second heat exchanger. The controller is configured, in the first mode, to fix a degree of opening of the first flow rate adjustment valve to a first degree of opening smaller than 100% and greater than 0%, and vary an operation frequency of the compressor in accordance with air conditioning performance required of the third heat exchanger, and is configured, in the second mode, to vary the degree of opening of the first flow rate adjustment valve in accordance with air conditioning performance required of the third heat exchanger, and the controller is configured to change the operation mode from the first mode to the second mode, when a difference between the air conditioning performance required of the third heat exchanger and air conditioning performance offered by the third heat exchanger becomes greater than a prescribed value.

A controller according to another aspect of the present disclosure controls an air conditioning apparatus configured to operate in operation modes including a first mode and a second mode, the air conditioning apparatus including: a compressor configured to compress a first heat medium; a first heat exchanger configured to exchange heat between the first heat medium and outdoor air; a second heat exchanger configured to exchange heat between the first heat medium and a second heat medium; a third heat exchanger configured to exchange heat between the second heat medium and indoor air; a first flow rate adjustment valve configured to adjust a flow rate of the second heat medium flowing in the third heat exchanger; a fourth heat exchanger provided in parallel with the third heat exchanger and configured to exchange heat between the second heat medium and the indoor air; a second flow rate adjustment valve configured to adjust a flow rate of the second heat medium flowing in the fourth heat exchanger; and a pump configured to circulate the second heat medium between the third heat exchanger and the second heat exchanger. When a first difference between air conditioning performance required of the third heat exchanger and air conditioning performance offered by the third heat exchanger is greater than a second difference between air conditioning performance required of the fourth heat exchanger and air conditioning performance offered by the fourth heat exchanger, the controller is configured, in the first mode, to fix a degree of opening of the first flow rate adjustment valve to a first degree of opening smaller than 100% and greater than 0% and control an operation frequency of the compressor so as to bring the first difference to zero, and control a degree of opening of the second flow rate adjustment valve so as to bring the second difference to zero.

According to the air conditioning apparatus, the heat source apparatus and the controller of the present disclosure, air conditioning performance immediately follows variation in required indoor load, thus improving comfort.

DETAILED DESCRIPTION

Figure 1:
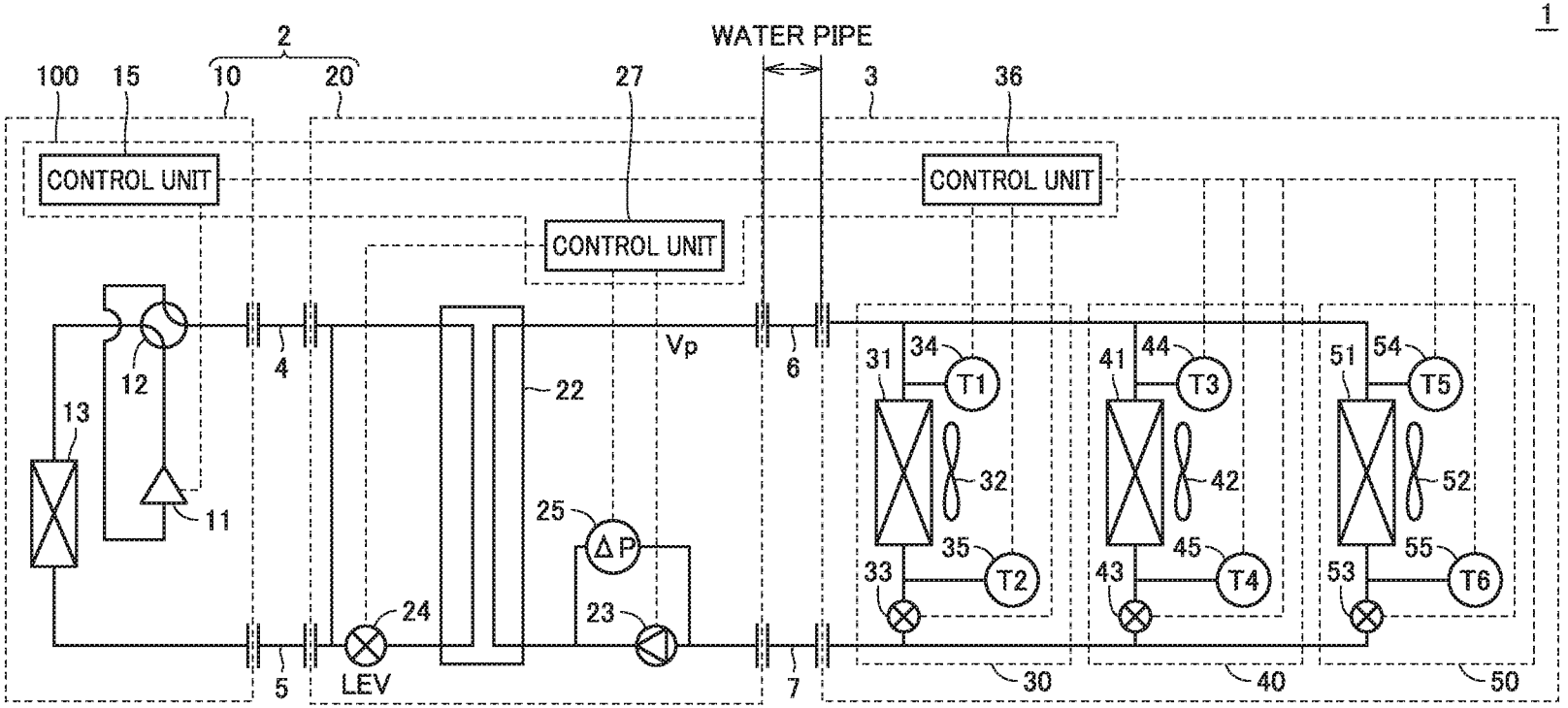
FIG. 1 shows the configuration of an air conditioning apparatus according to the present embodiment.

In the following, embodiments of the present disclosure will be described in detail with reference to the drawings. While a plurality of embodiments are described below, it has been intended from the time of filing of the present application to appropriately combine configurations described in the respective embodiments. Note that the same or corresponding parts are designated by the same characters in the drawings and will not be described repeatedly.

FIG. 1 shows the configuration of an air conditioning apparatus according to the present embodiment. Referring to FIG. 1, an air conditioning apparatus 1 includes a heat source apparatus 2, an indoor air conditioning device 3, and a controller 100. Heat source apparatus 2 includes an outdoor unit 10 and a relay unit 20. In the following description, a first heat medium can be exemplified by refrigerant, and a second heat medium can be exemplified by water or brine.

Outdoor unit 10 includes part of a refrigeration cycle that operates as a heat source or a cold source for the first heat medium. Outdoor unit 10 includes a compressor 11, a four-way valve 12, and a first heat exchanger 13. FIG. 1 shows an example where four-way valve 12 performs cooling, with heat source apparatus 2 serving as a cold source. When four-way valve 12 is switched to reverse the direction of circulation of the refrigerant, heating is performed, with heat source apparatus 2 serving as a heat source.

Relay unit 20 includes a second heat exchanger 22, a pump 23 for circulating the second heat medium between indoor air conditioning device 3 and the outdoor unit, an expansion valve 24, and a pressure sensor 25 for detecting a differential pressure $\Delta P$ before and after pump 23. Second heat exchanger 22 exchanges heat between the first heat medium and the second heat medium. A plate heat exchanger can be used as second heat exchanger 22.

Outdoor unit 10 and relay unit 20 are connected to each other by pipes 4 and 5 for flowing the first heat medium. Compressor 11, four-way valve 12, first heat exchanger 13, expansion valve 24, and second heat exchanger 22 form a first heat medium circuit which is a refrigeration cycle using the first heat medium. Note that outdoor unit 10 and relay unit 20 may be integrated together in heat source apparatus 2. If they are integrated together, pipes 4 and 5 are accommodated in a casing.

Indoor air conditioning device 3 and relay unit 20 are connected to each other by pipes 6 and 7 for flowing the second heat medium. Indoor air conditioning device 3 includes an indoor unit 30, an indoor unit 40 and an indoor unit 50. Indoor units 30, 40 and 50 are connected in parallel with one another between pipe 6 and pipe 7.

Indoor unit 30 includes a third heat exchanger 31, an indoor fan 32 for delivering indoor air to third heat exchanger 31, a (first flow rate adjustment valve) flow rate adjustment valve 33 for adjusting a flow rate of the second heat medium, and temperature sensors 34, 35. Third heat exchanger 31 exchanges heat between the second heat medium and the indoor air. Temperature sensor 34 measures a temperature of the second heat medium at an inlet side of third heat exchanger 31. Temperature sensor 35 measures a temperature of the second heat medium at an outlet side of third heat exchanger 31.

Indoor unit 40 includes a fourth heat exchanger 41, an indoor fan 42 for delivering indoor air to fourth heat exchanger 41, a second flow rate adjustment valve 43 for adjusting a flow rate of the second heat medium, and temperature sensors 44, 45. Fourth heat exchanger 41 exchanges heat between the second heat medium and the indoor air. Temperature sensor 44 measures a temperature of the second heat medium at an inlet side of fourth heat exchanger 41. Temperature sensor 45 measures a temperature of the second heat medium at an outlet side of fourth heat exchanger 41.

Indoor unit 50 includes a fifth heat exchanger 51, an indoor fan 52 for delivering indoor air to fifth heat exchanger 51, a third flow rate adjustment valve 53 for adjusting a flow rate of the second heat medium, and temperature sensors 54, 55. Fifth heat exchanger 51 exchanges heat between the second heat medium and the indoor air. Temperature sensor 54 measures a temperature of the second heat medium at an inlet side of fifth heat exchanger 51. Temperature sensor 55 measures a temperature of the second heat medium at an outlet side of fifth heat exchanger 51.

Note that pump 23, second heat exchanger 22, and parallel-connected third heat exchanger 31, fourth heat exchanger 41 and fifth heat exchanger 51 which will be described later form a second heat medium circuit which is a refrigeration cycle using the second heat medium. While an air conditioning apparatus having three indoor units is illustrated by way of example in the present embodiment, a similar effect is obtained with any number of indoor units.

Control units 15, 27 and 36 distributed among outdoor unit 10, relay unit 20 and indoor air conditioning device 3 cooperate with one another to operate as controller 100. Controller 100 controls compressor 11, expansion valve 24, pump 23, first flow rate adjustment valve 33, second flow rate adjustment valve 43, third flow rate adjustment valve 53, and indoor fans 32, 42, 52 in response to outputs from pressure sensor 25 and temperature sensors 34, 35, 44, 45, 54, 55.

Note that one of control units 15, 27 and 36 may serve as a controller, and control compressor 11, expansion valve 24, pump 23, first flow rate adjustment valve 33, second flow rate adjustment valve 43, third flow rate adjustment valve 53, and indoor fans 32, 42, 52 based on data detected by the other control units 15, 27 and 36. Note that if heat source apparatus 2 has outdoor unit 10 and relay unit 20 that are integrated together, control units 15 and 27 may cooperate with each other to operate as a controller based on data detected by control unit 36.

In a water air conditioning system in which the second heat medium (water or brine) is delivered from heat source apparatus 2 to the plurality of heat exchangers 31, 41 and 51 on the use side in this manner, heat source apparatus 2 and heat exchangers 31, 41, 51 are distant from each other. Even if the temperature of the second heat medium delivered from heat source apparatus 2 is varied upon variation in required air conditioning load due to a change in set temperature on a remote controller or the like, it takes time for the second heat medium at the varied temperature to pass through pipes 6 and 7 to be actually transported to the indoor side. Therefore, the variation in indoor load is poorly followed by air conditioning performance of indoor units 30, 40 and 50, resulting in compromised comfort.

For this reason, air conditioning apparatus 1 in the present embodiment has a first mode performed in a steady state and a second mode performed in an unsteady state, as operation modes.

For ease of explanation, an example where indoor units 40 and 50 are in a stopped state and only indoor unit 30 is operating is initially described.

In order to select an operation mode, controller 100 determines whether or not performance Qr offered by indoor unit 30 is within a determination range (±AkW) with respect to performance Qx required of indoor unit 30.

The performance required of indoor unit 30 can be calculated as: required performance Qx=(Ts-Tr)×K, for example, where Ts represents a set temperature (set with a remote controller), Tr represents an indoor temperature (measured with an intake air temperature sensor), and K represents a coefficient (a number determined by the space to be air conditioned, such as the size of a room).

Performance Qr offered by indoor unit 30, on the other hand, can be expressed by: Qr=m×Cp×ΔT, where m represents an amount of circulation of the second heat medium, and Cp represents a specific heat of the second heat medium. The amount of circulation of the second heat medium (an amount m of water circulation) is calculated as described below.

Figure 2:
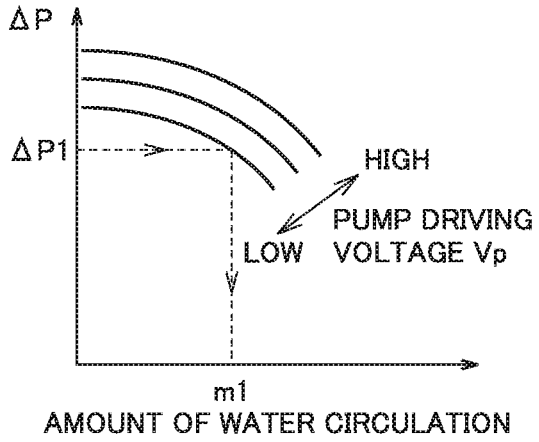
FIG. 2 shows relation between an amount of water circulation and a differential pressure.

FIG. 2 shows relation between the amount of water circulation and the differential pressure. Each curve shown in FIG. 2 represents a head characteristic of pump 23, and the head characteristic is known in advance for each driving voltage of pump 23. Controller 100 calculates amount m of water circulation based on differential pressure ΔP before and after pump 23, a pump driving voltage Vp, and the pump head characteristic shown in FIG. 2. Calculated amount m of water circulation is then multiplied by the specific heat and a temperature difference ΔT(=T1-T2), to calculate performance Qr offered by indoor unit 30.

When pump 23 has a delivery amount of 30 [L/min], for example, with amount m of water circulation=1.8 [$m^3$/h], specific heat Cp=4.21 [KJ/kgK], water temperature difference ΔT=5 [K], and density ρ=1000 [kg/$m^3$], then performance Qr can be calculated as:

$$Qr=1.8*4.21*5*1000=37890[KJ/h]\approx 10.5\ kW$$

When Qx-Qr is within ±Akw, controller 100 sets the operation mode to the first mode, and when Qx-Qr is not within ±Akw, controller 100 sets the operation mode to the second mode.

In the first mode, controller 100 fixes a degree of opening of first flow rate adjustment valve 33 to a first degree of opening smaller than 100% and greater than 0% (for example, 80%), and varies an operation frequency fc of compressor 11 in accordance with the air conditioning performance required of third heat exchanger 31.

In the second mode, controller 100 varies the degree of opening of first flow rate adjustment valve 33 in accordance with the air conditioning performance required of third heat exchanger 31. When a difference between air conditioning performance Qx required of third heat exchanger 31 and air conditioning performance Qr offered by third heat exchanger 31 becomes greater than the determination value (±AkW) which is a prescribed value, controller 100 changes the operation mode from the first mode to the second mode.

In the following, the operation of the air conditioning apparatus in the present embodiment is described using a waveform diagram of a comparative example and a waveform diagram of the present embodiment.

Figure 3:
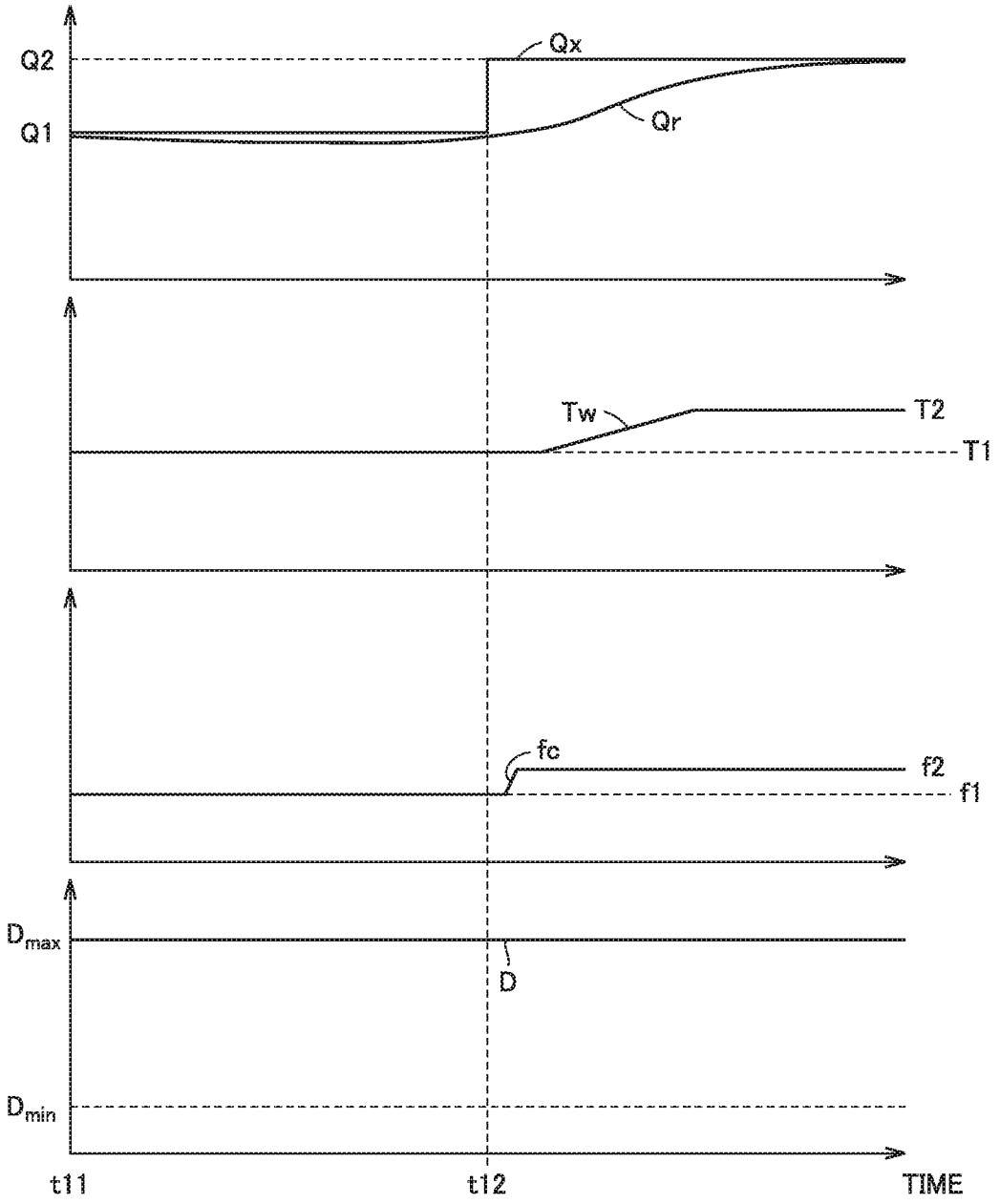
FIG. 3 is a waveform diagram to illustrate operation of an air conditioning apparatus in a comparative example.
Figure 4:
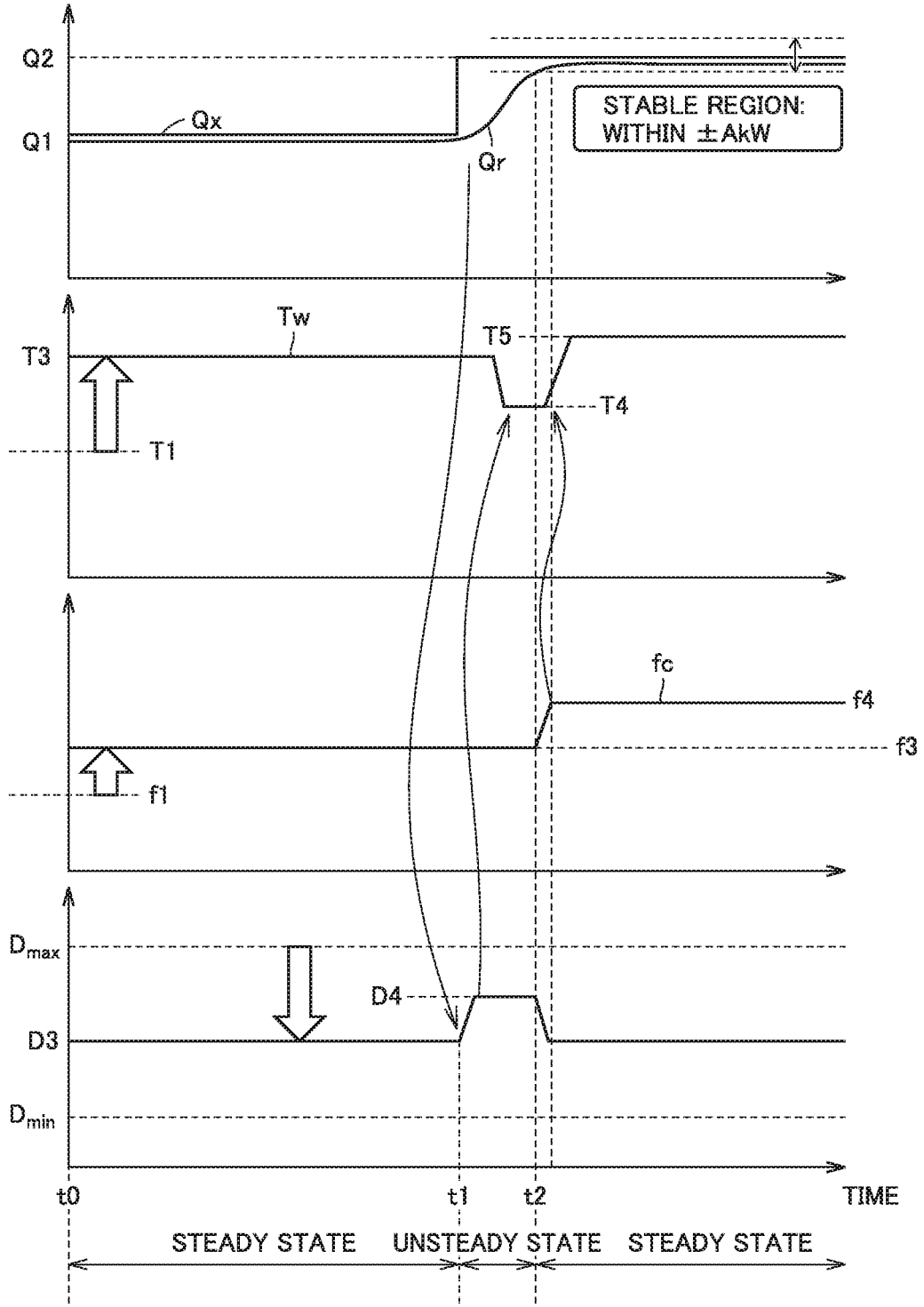
FIG. 4 is a waveform diagram to illustrate operation of the air conditioning apparatus in the present embodiment.

FIG. 3 is a waveform diagram to illustrate the operation of an air conditioning apparatus in the comparative example. FIG. 4 is a waveform diagram to illustrate the operation of the air conditioning apparatus in the present embodiment.

In the comparative example of FIG. 3, between times t11 and t12, required performance Qx is set to Q1, and a temperature Tw of the second heat medium delivered from heat source apparatus 2 is stable at a temperature T1. At this time, operation frequency fc of compressor 11 in heat source apparatus 2 is a frequency f1, and a degree of opening D of first flow rate adjustment valve 33 is a maximum degree of opening Dmax.

At time t12, required performance Qx is changed from Q1 to Q2 by operation of the remote controller or the like. In response, operation frequency fc of compressor 11 is increased from frequency f1 to a frequency f2, and temperature Tw of the second heat medium delivered from heat source apparatus 2 gradually increases from temperature T1 to a temperature T2 (in the case of heating). As a result of the increased temperature of the second heat medium, air conditioning performance Qr offered by indoor unit 30 also gradually approaches required performance Qx.

In contrast to such control in the comparative example, in the present embodiment, degree of opening D of first flow rate adjustment valve 33 and operation frequency fc of compressor 11 are controlled as shown in FIG. 4.

In the example of the present embodiment of FIG. 4, between times t0 and t1, required performance Qx is set to Q1, and temperature Tw of the second heat medium delivered from heat source apparatus 2 is stable at a temperature T3 higher than temperature T1. At this time, operation frequency fc of compressor 11 in heat source apparatus 2 is f3 higher than frequency f1, and degree of opening D of first flow rate adjustment valve 33 is set to an intermediate value D3 between maximum degree of opening Dmax and a minimum degree of opening Dmin Intermediate value D3 is a reference value that is set in the steady state. By setting degree of opening D of first flow rate adjustment valve 33 to intermediate value D3 in the steady state, degree of opening D of first flow rate adjustment valve 33 can be varied upon change in required performance Qx, to change performance Qr offered by indoor unit 30 either to increase or reduce the performance.

At time t1, required performance Qx is changed from Q1 to Q2 by operation of the remote controller or the like. In response, controller 100 first varies the degree of opening of first flow rate adjustment valve 33 from intermediate value D3 to a degree of opening D4, so as to bring the degree of opening closer to maximum degree of opening Dmax. In response, the flow rate of the second heat medium to indoor unit 30 increases, and performance Qr increases more rapidly than in the comparative example. As a result of the increased flow rate, temperature Tw of the second heat medium delivered from heat source apparatus 2 decreases from temperature T3 to T4.

When air conditioning performance Qr offered by indoor unit 30 reaches within the determination value (±AkW) with respect to required performance Qx at time t2, controller 100 returns the degree of opening of first flow rate adjustment valve 33 from degree of opening D4 to original degree of opening D3, and increases operation frequency fc of compressor 11 from frequency f3 to a frequency f4. As a result, temperature Tw of the second heat medium delivered from heat source apparatus 2 increases from temperature T4 to a temperature T5 (in the case of heating).

In the unsteady operation between times t1 and t2, operation is performed in which the degree of opening of first flow rate adjustment valve 33 is varied to cause offered performance Qr to follow required performance Qx, and then the degree of opening of first flow rate adjustment valve 33 is returned to the reference value while the frequency of compressor 11 is controlled to maintain the following of required performance Qx.

Subsequently, operation in the steady state is continued, where air conditioning performance Qr offered by indoor unit 30 is within the determination value of required performance Qx.

Figure 5:
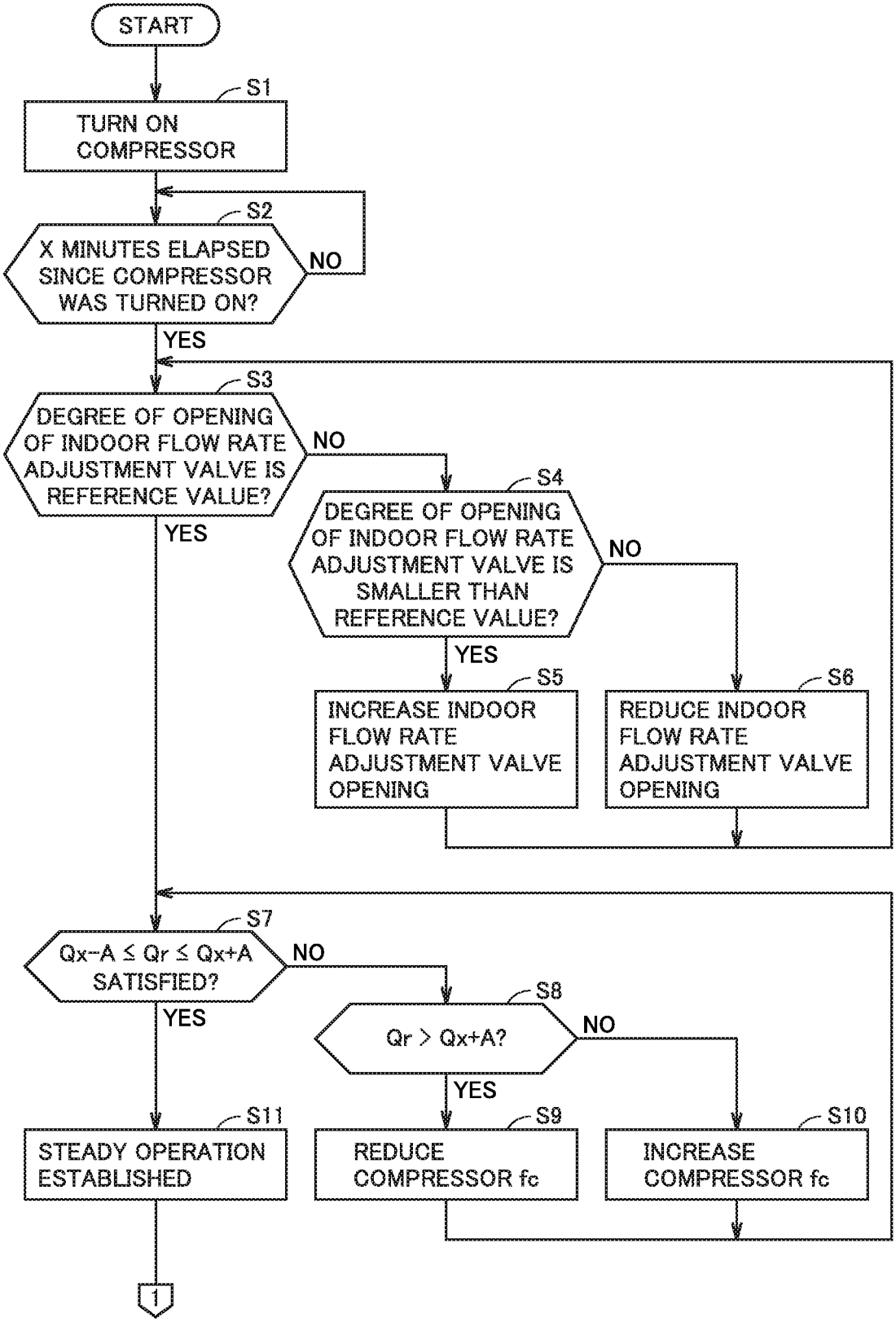
FIG. 5 is a flowchart (first half) to illustrate a process performed by a controller 100.
Figure 6:
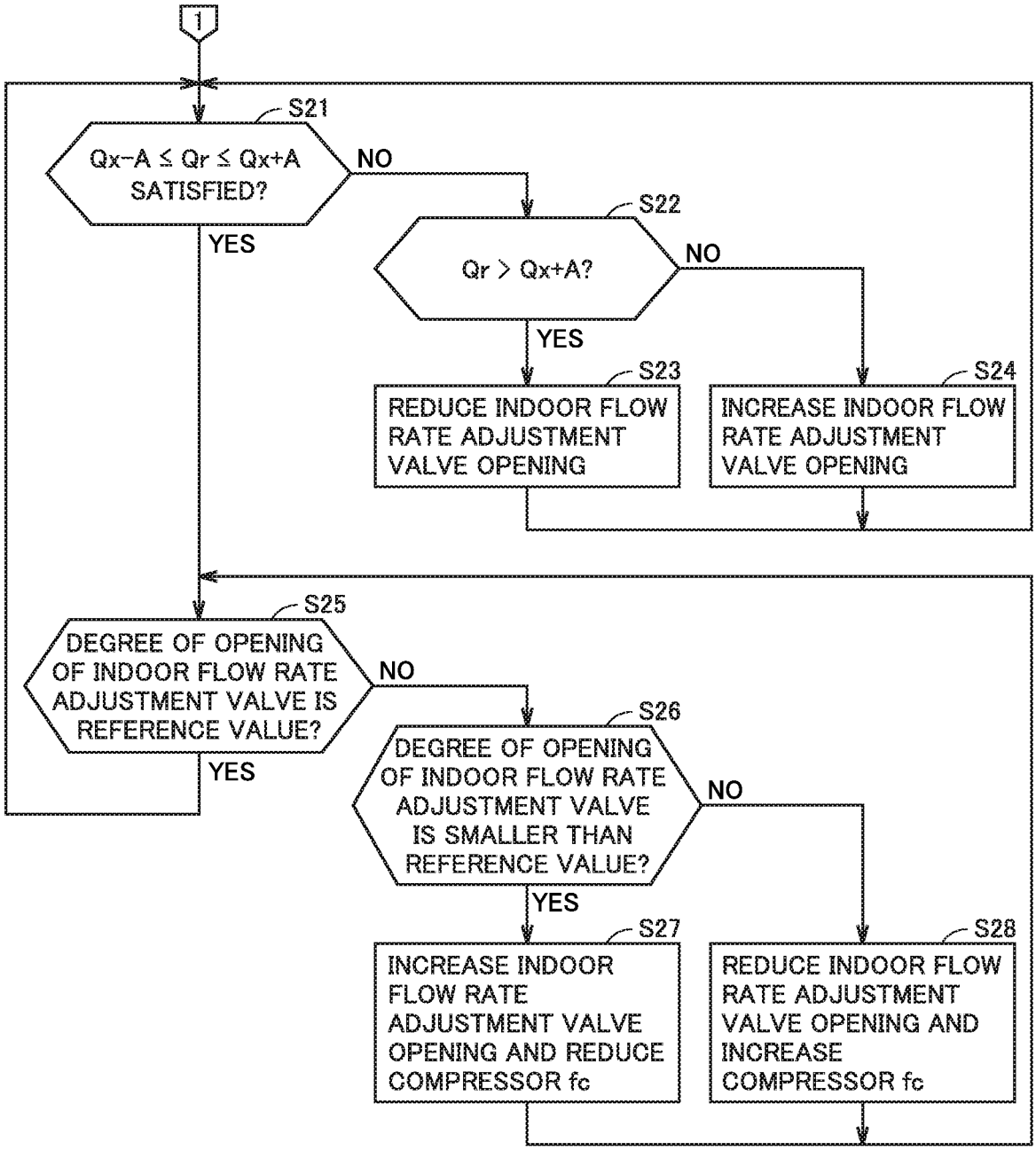
FIG. 6 is a flowchart (second half) to illustrate the process performed by controller 100.

FIG. 5 is a flowchart (first half) to illustrate the process performed by controller 100. FIG. 6 is a flowchart (second half) to illustrate the process performed by controller 100.

Referring to FIG. 5, first, in step S1, controller 100 starts operation of compressor 11. Then, in step S2, controller 100 waits until X minute(s) have elapsed since the start of operation of compressor 11. After X minute(s) have elapsed, in step S3, controller 100 determines whether or not degree of opening D of first flow rate adjustment valve 33 is the reference value (for example, 80%).

When degree of opening D of first flow rate adjustment valve 33 is not the reference value (NO in S3), in step S4, controller 100 determines whether or not degree of opening D of first flow rate adjustment valve 33 is smaller than the reference value.

When degree of opening D of first flow rate adjustment valve 33 is smaller than the reference value (YES in S4), in step S5, controller 100 varies the degree of opening of first flow rate adjustment valve 33 so as to increase the degree of opening. When degree of opening D of first flow rate adjustment valve 33 is greater than the reference value (NO in S4), on the other hand, in step S5, controller 100 varies the degree of opening of first flow rate adjustment valve 33 so as to reduce the degree of opening. The variation width of the degree of opening in steps S5 and S6 can be in steps of 1%, for example. After varying the degree of opening of first flow rate adjustment valve 33 in step S5 or step S6, controller 100 performs the process of step S3 again.

When degree of opening D of first flow rate adjustment valve 33 is the reference value (YES in S3), in step S7, controller 100 determines whether or not air conditioning performance Qr being offered by indoor unit 30 is within the determination value (±AkW).

When air conditioning performance Qr being offered by indoor unit 30 is not within the determination value (±AkW) (NO in S7), controller 100 proceeds the process to step S8.

When air conditioning performance Qr being offered by indoor unit 30 is greater than Qx+A (YES in S8), in step S9, controller 100 varies operation frequency fc of compressor 11 so as to reduce the operation frequency. When air conditioning performance Qr being offered by indoor unit 30 is smaller than or equal to Qx+A (NO in S8), on the other hand, air conditioning performance Qr is smaller than Qx-A, and thus in step S10, controller 100 varies operation frequency fc of compressor 11 so as to increase the operation frequency. The variation width of the degree of opening in steps S9 and S10 can be in steps of 1% of variable width of frequency, for example. After varying operation frequency fc of compressor 11 in step S9 or step S10, controller 100 performs the process of step S7 again.

When air conditioning performance Qr being offered by indoor unit 30 is within the determination value (±AkW) with respect to required performance Qx (YES in S7), controller 100 determines that the steady operation state has been established in step S11, and performs a process of step S21 and subsequent steps shown in FIG. 6.

In the process of step S21 and subsequent steps, a process is performed in which, first, in steps S21 to S24, the degree of opening of first flow rate adjustment valve 33 is varied to bring air conditioning performance Qr being offered by indoor unit 30 closer to required performance Qx, and then in steps S25 to S28, the degree of opening of first flow rate adjustment valve 33 is returned to the reference value while the operation frequency of compressor 11 is varied.

Specifically, in step S21, controller 100 determines whether or not air conditioning performance Qr being offered by indoor unit 30 is within the determination value (±AkW).

When air conditioning performance Qr being offered by indoor unit 30 is not within the determination value (±AkW) (NO in S21), controller 100 proceeds the process to step S22.

When air conditioning performance Qr being offered by indoor unit 30 is greater than Qx+A (YES in S22), in step S23, controller 100 varies the degree of opening of first flow rate adjustment valve 33 so as to reduce the degree of opening. When air conditioning performance Qr being offered by indoor unit 30 is smaller than or equal to Qx+A (NO in S22), on the other hand, air conditioning performance Qr is smaller than Qx-A, and thus in step S24, controller 100 varies the degree of opening of first flow rate adjustment valve 33 so as to increase the degree of opening.

Figure 7:
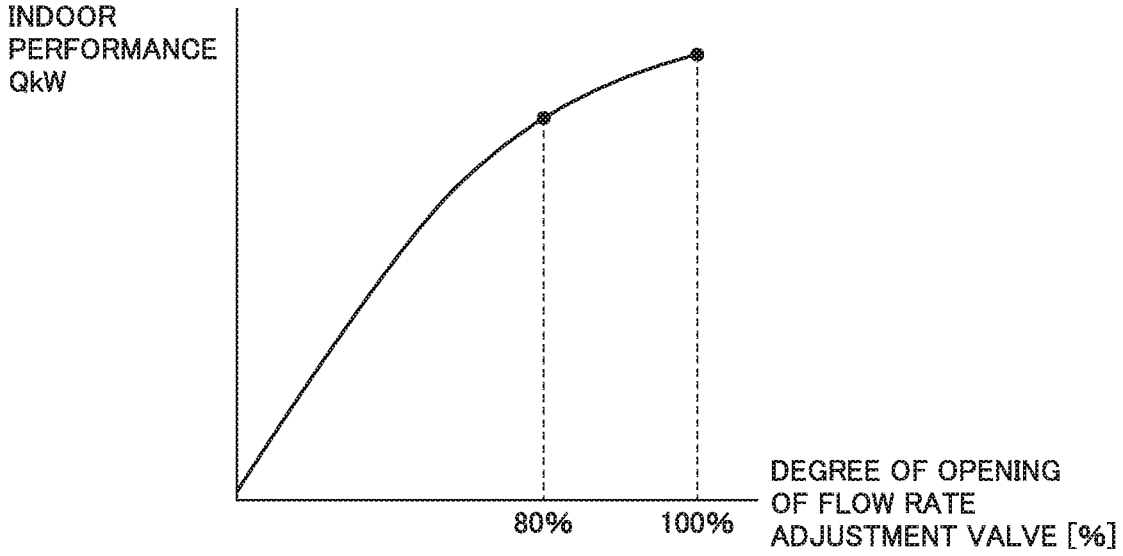
FIG. 7 is a graph showing relation between the degree of opening of a flow rate adjustment valve and air conditioning performance offered by an indoor unit.

FIG. 7 is a graph showing relation between the degree of opening of a flow rate adjustment valve and air conditioning performance offered by an indoor unit. The variation width of the degree of opening in steps S23 and S24 can be determined such that it is adapted to the air conditioning performance characteristic shown in FIG. 7 that was predetermined by experiment. The air conditioning performance of indoor unit 30 can thereby be caused to immediately follow required performance Qx. After varying the degree of opening of first flow rate adjustment valve 33 in step S23 or step S24, controller 100 performs the process of step S21 again.

When air conditioning performance Qr being offered by indoor unit 30 is within the determination value (±AkW) (YES in S21), on the other hand, controller 100 proceeds the process to step S25.

In step S25, controller 100 determines whether or not degree of opening D of first flow rate adjustment valve 33 is the reference value (for example, 80%).

When degree of opening D of first flow rate adjustment valve 33 is not the reference value (NO in S25), in step S26, controller 100 determines whether or not degree of opening D of first flow rate adjustment valve 33 is smaller than the reference value.

When degree of opening D of first flow rate adjustment valve 33 is smaller than the reference value (YES in S26), in step S27, controller 100 varies the degree of opening of first flow rate adjustment valve 33 so as to increase the degree of opening, and varies operation frequency fc of compressor 11 so as to reduce the operation frequency. When degree of opening D of first flow rate adjustment valve 33 is greater than the reference value (NO in S26), on the other hand, in step S28, controller 100 varies the degree of opening of first flow rate adjustment valve 33 so as to reduce the degree of opening, and varies operation frequency fc of compressor 11 so as to increase the operation frequency. For the variation width of the degree of opening and the variation width of the frequency in steps S27 and S28, values predetermined by experiment and the like such that the air conditioning performance does not change may be employed. After varying the degree of opening of first flow rate adjustment valve 33 and operation frequency fc of compressor 11 in step S27 or step S28, controller 100 performs the process of step S25 again.

When degree of opening D of first flow rate adjustment valve 33 is the reference value (YES in S25), controller 100 performs the process of step S21 and subsequent steps again.

While an example where indoor unit 30 is operated and indoor units 40 and 50 are stopped out of the plurality of indoor units 30, 40 and 50 in the configuration of FIG. 1 has been illustrated in the above description, similar control can be applied when indoor unit 40 or 50 is operated instead of indoor unit 30. Similar control can also be applied to a configuration in which a single indoor unit is connected to the heat source apparatus.

Example where there are a Plurality of Indoor Units to be Operated

In the present embodiment, when there are a plurality of indoor units to be operated, one representative unit is selected from among them and control is performed. The same control can be applied whether the plurality of indoor units are installed in the same air conditioning zone (space) or in different air conditioning zones.

For each indoor unit to be operated, required performance Qx and offered performance Qr are calculated, and an indoor unit having the largest |Qx-Qr| is selected as a representative unit. Then, in a manner similar to the control shown in the flowcharts of FIGS. 5 and 6, degree of opening D of the indoor flow rate adjustment valve of the representative unit is adjusted to be the reference value (for example, 80%), to adjust the temperature of water exiting from the heat source apparatus.

The flow rate adjustment valve of an indoor unit that was not selected as the representative unit is controlled so as to bring the difference between required performance Qx and offered performance Qr of that indoor unit to zero.

A specific example where indoor unit 30 is operating as the representative unit and indoor unit 40 is additionally operating is described.

When a first difference ΔQ1 between air conditioning performance Qx (31) required of third heat exchanger 31 and air conditioning performance Qr (31) offered by third heat exchanger 31 is greater than a second difference ΔQ2 between air conditioning performance Qx (41) required of fourth heat exchanger 41 and air conditioning performance Qr (41) offered by fourth heat exchanger 41, in the first mode, controller 100 fixes first flow rate adjustment valve 33 to the first degree of opening (for example, 80%) and controls operation frequency fc of compressor 11 so as to bring first difference ΔQ1 to zero, and controls the degree of opening of second flow rate adjustment valve 43 so as to bring second difference ΔQ2 to zero. Note that when indoor unit 50 is also operating, one representative unit is similarly selected, and similar control is performed for the representative unit, and the flow rate adjustment valve of an indoor unit that was not selected as the representative unit is controlled so as to bring the difference between required performance Qx and offered performance Qr of that indoor unit to zero.

By performing such control, variation in indoor load can be better followed by the temperature of a room when a plurality of indoor units are operated, so that comfort in the room can be improved in the market.

It should be understood that the embodiments disclosed herein are illustrative and non-restrictive in every respect. The basic scope of the present disclosure is defined by the terms of the claims, rather than the description of the embodiments above, and is intended to include any modifications within the meaning and scope equivalent to the terms of the claims.

The invention claimed is:

1. A controller that controls an air conditioning apparatus configured to operate in operation modes including a first mode and a second mode, the air conditioning apparatus having a compressor configured to compress a first heat medium, a first heat exchanger configured to exchange heat between the first heat medium and outdoor air, a second heat exchanger configured to exchange heat between the first heat medium and a second heat medium, a third heat exchanger configured to exchange heat between the second heat medium and indoor air, a first flow rate adjustment valve configured to adjust a flow rate of the second heat medium flowing in the third heat exchanger, and a pump configured to circulate the second heat medium between the third heat exchanger and the second heat exchanger, the controller configured:

in the first mode, to fix a degree of opening of the first flow rate adjustment valve to a first degree of opening smaller than 100% and greater than 0%, and vary an operation frequency of the compressor in accordance with air conditioning performance required of the third heat exchanger, and being configured, in the second mode, to vary the degree of opening of the first flow rate adjustment valve in accordance with air conditioning performance required of the third heat exchanger, and to change the operation mode from the first mode to the second mode, when a difference between the air conditioning performance required of the third heat exchanger and air conditioning performance offered by the third heat exchanger becomes greater than a prescribed value.

2. The controller according to claim 1, wherein the controller is configured, in the first mode, to control the operation frequency of the compressor so as to reduce the difference between the air conditioning performance required of the third heat exchanger and the air conditioning performance offered by the third heat exchanger, while fixing the degree of opening of the first flow rate adjustment valve to the first degree of opening.

3. A controller that controls an air conditioning apparatus configured to operate in operation modes including a first mode and a second mode, the air conditioning apparatus comprising:

a compressor configured to compress a first heat medium;

a first heat exchanger configured to exchange heat between the first heat medium and outdoor air;

a second heat exchanger configured to exchange heat between the first heat medium and a second heat medium;

a third heat exchanger configured to exchange heat between the second heat medium and indoor air;

a first flow rate adjustment valve configured to adjust a flow rate of the second heat medium flowing in the third heat exchanger;

a fourth heat exchanger provided in parallel with the third heat exchanger and configured to exchange heat between the second heat medium and the indoor air;

a second flow rate adjustment valve configured to adjust a flow rate of the second heat medium flowing in the fourth heat exchanger; and a pump configured to circulate the second heat medium between the third heat exchanger and the second heat exchanger, when a first difference between air conditioning performance required of the third heat exchanger and air conditioning performance offered by the third heat exchanger is greater than a second difference between air conditioning performance required of the fourth heat exchanger and air conditioning performance offered by the fourth heat exchanger, the controller being configured, in the first mode, to fix a degree of opening of the first flow rate adjustment valve to a first degree of opening smaller than 100% and greater than 0% and control an operation frequency of the compressor so as to bring the first difference to zero, and control a degree of opening of the second flow rate adjustment valve so as to bring the second difference to zero.

4. The controller according to claim 1, further comprising an outdoor unit including the compressor, and the first heat exchanger.

5. The controller according to claim 1, further comprising a relay unit including the second heat exchanger, and the pump.

6. The controller according to claim 1, further comprising a heat source apparatus including the compressor, the first heat exchanger, the second heat exchanger, and the pump.

7. The controller according to claim 1, further comprising an air conditioning system including a first heat medium circuit formed by the compressor, the first heat exchanger and the second heat exchanger; and a second heat medium circuit formed by the pump, the second heat exchanger and the third heat exchanger.

* * * * *